United States Patent [19]

Singletary

[11] Patent Number: 4,878,307

[45] Date of Patent: Nov. 7, 1989

[54] GUNSIGHT MOUNTING DEVICE FOR A REVOLVER

[75] Inventor: Larry F. Singletary, Thomasville, Ga.

[73] Assignee: L&S Technologies, Inc., Thomasville, Ga.

[21] Appl. No.: 184,774

[22] Filed: Apr. 22, 1988

[51] Int. Cl.[4] ..... F41G 1/38

[52] U.S. Cl. ..... 42/101; 33/245

[58] Field of Search ..... 42/101, 103; 33/245, 33/246, 247, 248, 249, 250; 362/110

[56] References Cited

U.S. PATENT DOCUMENTS

| | | | |
|---|---|---|---|
| 1,107,040 | 8/1914 | Conde | 362/110 |
| 1,756,603 | 4/1930 | Noske | 42/101 |
| 2,108,475 | 2/1938 | Cooper | 362/110 |
| 2,645,855 | 10/1951 | Ivy | 33/248 |
| 3,834,052 | 9/1974 | Steck, III | 42/101 |
| 3,919,781 | 11/1975 | Chaba | 42/100 |
| 3,922,794 | 12/1975 | Ackerman, Jr. | 42/101 |
| 4,328,624 | 5/1982 | Ross | 42/101 |
| 4,418,487 | 12/1983 | Strahan | 42/101 |

OTHER PUBLICATIONS

*The American Rifleman*, "Scope Your Handguns for Higher Scores", Jun. 1974, pp. 34 & 35.

*Primary Examiner*—Deborah L. Kyle
*Assistant Examiner*—Michael J. Carone
*Attorney, Agent, or Firm*—Jones, Askew & Lunsford

[57] ABSTRACT

A mount for securing a gunsight to the top of a revolver. The mount is secured to the sideplate of the revolver by at least one screw which passes laterally therethrough. Two existing sideplate screws are removed and replaced by specially configured auxiliary screws threadably received in existing tapped holes in the revolver frame. The mounting device includes a first portion adjacent the side plate of the revolver, a second portion extending vertically upward along the rear frame portion of the revolver and a third horizontally projecting upper portion that receives the gunsight. The horizontally projecting upper portion is fitted with two inwardly projecting opposing rails aligned at a diagonal angle relative to a true vertical. The inwardly projecting rails provide repeated accurate securing of the mount to the firearm.

9 Claims, 2 Drawing Sheets

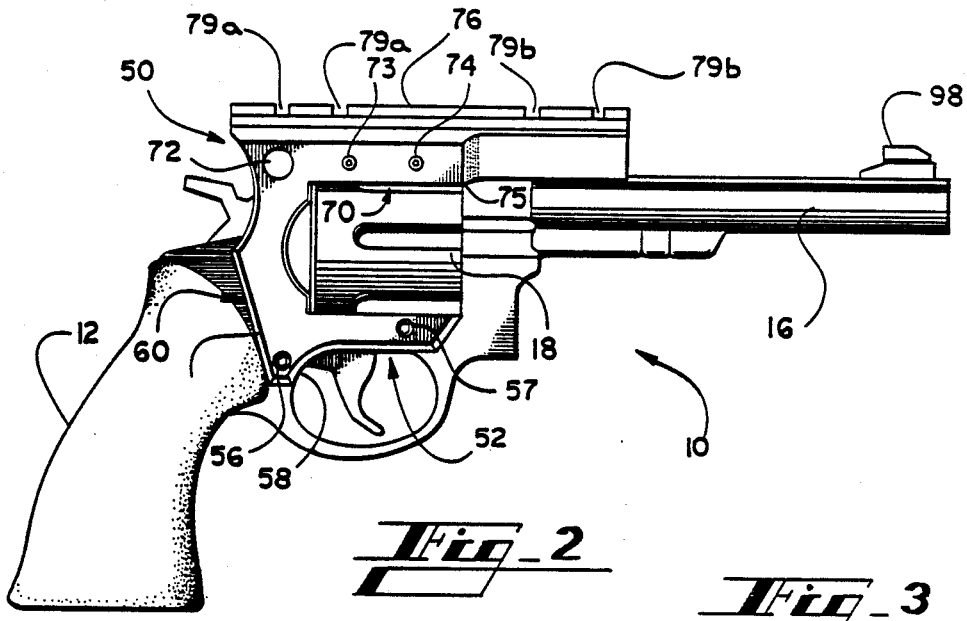
Fig_2
Fig_3
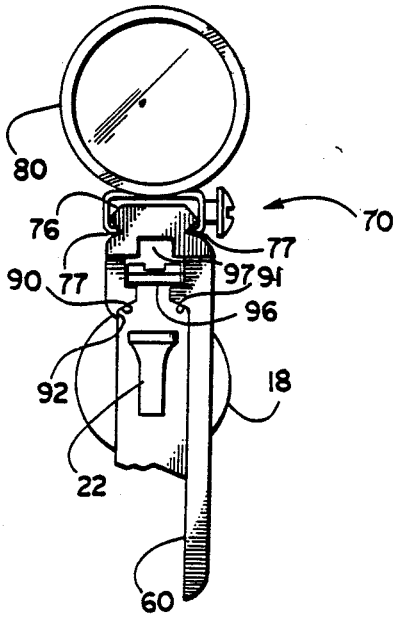
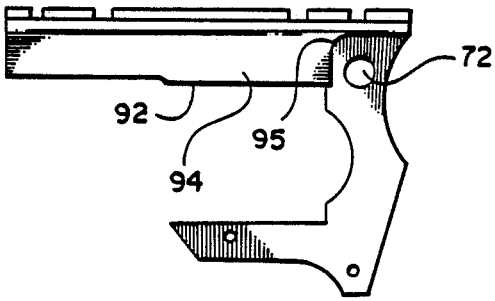
Fig_4

GUNSIGHT MOUNTING DEVICE FOR A REVOLVER

TECHNICAL FIELD

The present invention relates to gunsight mounting devices for handguns and, more particularly, to a gunsight mounting device for a revolver whereby a sight or scope can be attached to the revolver without modification or machining of either the sight or the revolver.

BACKGROUND OF THE INVENTION

Various types of handguns are known in the art. A distinction is typically made between a revolver and an automatic pistol. A revolver is characterized by a rotating cylinder containing several cartridges that may be fired in quick succession without reloading. An automatic pistol is characterized by a magazine or a clip from which cartridges are automatically fed to a firing chamber for propulsion out of the barrel.

Regardless of type, a handgun has long been recognized as a weapon difficult to fire with consistent accuracy. Conventional firing calls for the shooter to sight a target along a rear sight and a front sight provided on the top of the gun. Depending on where the bullet lands in relation to the target, the shooter will compensate accordingly. Compensation may be required for such factors as distance, wind, and speed or size of the target. Due to the difficulty of making such compensations, handgun manufacturers have provided sighting devices with the firearm.

By way of example, reference is had to a conventional revolver manufactured by Smith & Wesson. The top-strap of a Smith & Wesson revolver is formed as an arcuate surface that defines an apex at its uppermost portion. Rear sights are typically provided at this apex and classified as "fixed" or "adjustable". A fixed rear sight comprises a trough cut at the apex of the radius in such a position as to be in alignment with the front sight provided on the end of the barrel. It is also well-known to mount an adjustable sight at this position. An adjustable sight is more desirable, as it can be adjusted up and down, or left and right. Both "fixed" and "adjustable" sights are designed for shooting at relatively close range. While such sights are very accurate, they are limited by the shooter's eyesight and knowledge of the shooting pattern of the revolver.

Due to the difficulty of making such compensations, the need for a device by which the shooter may repeatedly and quickly sight a target at long range has been known for many years. As a result, various sighting devices have been provided for use in both competition shooting and handgun hunting. For example, telescopic sights have long been used, and electronic sights and laser sighting devices are now offered to the general public. Such gunsights have been traditionally mounted to the handgun by one of two methods. The first method calls for the barrel of the revolver to be drilled and tapped and/or the top-strap of the revolver to be drilled and tapped to accept a dove-tailed rail to which a sight is clamped. The second method calls for the removal of an adjustable rear sight and installation of a clamping assembly in the resulting void. Alternatively, the clamping assembly may be drilled and tapped in combination with the revolver. Drilling and tapping of any firearm is undesirable because of the cost, the potential for causing damage to the firearm, and the requirement that a skilled gunsmith must be employed to perform this operation. These factors served for many years to deter handgun owners from utilizing anything but the standard factory issued gunsights.

The handgun art has developed to such a stage, however, that revolvers are being retrofitted with scopes and sights with something other than the standard metallic factory issue. These after-market sighting devices provide the benefit of a scope or sight, but highlight the need for professional conduct of the mounting operation. In retrofitting any handgun for a gunsight, it is preferred that the sight be mounted to the revolver without disrupting the balance thereof so as to provide consistent and smooth firing.

Thus, there exists a need for a gunsight mounting device that can be readily affixed to the revolver without drilling, tapping or like modification to the revolver, but still provides a balanced firearm. Further, the need exists for a mounting device that facilitates repeated and accurate attachment of after-market gunsights to a revolver without need of a skilled gunsmith to perform this operation.

SUMMARY OF THE INVENTION

The present invention solves the above-described problems in the prior art by providing a gunsight mounting device which can be secured to a revolver without any drilling and tapping of auxiliary holes to receive any mounting screws. The present invention further solves the above-described problems by providing a mounting device that facilitates attachment of a long-range after-market sight to a revolver without need of a skilled gunsmith to perform the mounting operation.

The gunsight mounting device of this invention is characterized by a side plate mounting arrangement that can be used with any revolver having at least one screw that extends laterally through a side or sideplate of the gun, this screw being used to hold the sideplate in place on the frame thereof. Firearms of this type are quite common, and are exemplified by revolvers manufactured by the Smith & Wesson Company, Models "K", "L" and "N". It is of course to be understood that the present invention can be used with any firearm having at least one lateral screw as described herein.

Generally described, the gunsight mounting device of the present invention comprises means for receiving a gunsight, and means for attaching the receiving means to the side plate of a revolver, whereby a gunsight may be mounted upon the revolver for use by a shooter.

Described somewhat more particularly, the gunsight mounting device of the present invention is provided for a revolver having a barrel and at least one side plate through which at least one screw extends laterally. The gunsight mounting device comprises a receiving frame including three integrally formed portions. The first portion of the mounting device comprises a lower section of the device and is formed so as to lie adjacent and be secured to a side of the revolver. The second portion of the mounting device comprises an upper section thereof and includes means for receiving a gunsight. The third portion of the mounting device comprises a section that interconnects the first and second portions to provide an integral mounting device. Like the first portion, the third portion of the device is configured to lie adjacent to a side of the revolver without interrupting the operation of the rotating cylinder.

The underside of the second portion of the frame includes two opposing rails angled relative to a true vertical. When the device is mounted upon the revolver, the opposing rails bear against the top-strap of the revolver in such a manner as to center the gunsight mounting device over the bore of the revolver. Such rails thereby insure repeated accurate attachment of the mounting device and, in turn, the gunsight supported by the mounting device.

The first portion of the mounting device includes at least one opening which is positioned so as to lie in registry with the sideplate screw opening (or openings) conventionally disposed in the sideplate of the revolver, and with the existing underlying hole drilled and tapped in the frame of the revolver. At least one auxiliary screw is provided which first passes through the corresponding opening of the first portion of the mounting device, and then into a second opening conventionally disposed in the sideplate opening of the revolver to engage another existing hole drilled and tapped in the frame. These screws engage the existing drilled and tapped holes in the frame of the revolver, and hold the first portion of the mounting device snugly against the sideplate on the one side of the revolver. In the case of revolvers lacking a separate sideplate, the screws extend into existing tapped holes in the side of the frame and secure the first portion of the mounting device directly alongside the frame of the revolver. The auxiliary screws are provided to replace the conventional sideplate screws of the revolver. Thus, the auxiliary screw (or screws), when installed, replace the sideplate screws so as to hold parts of the revolver together and secure the mounting device to the revolver. The auxiliary screws are somewhat longer than the conventional sideplate screws they replace, so that the forward end of each auxiliary screw is threadably received in the frame and the lead end projects beyond the sidewall a predetermined distance at the tail end, such predetermined distance being approximately equal to the thickness dimension of the first portion of the mounting device. The rear end of each auxiliary screw has an enlarged head to engage and retain the first portion of the mounting device, and the head is provided with tool-receiving means, such as a hex head fitted opening, to facilitate securing the auxiliary screws to the frame of the revolver.

Thus, it is an object of the present invention to provide an improved gunsight mounting device.

It is a further object of the present invention to provide a gunsight mounting device that can be secured to a revolver without any drilling, tapping or like modification or machining of the revolver to accommodate the mounting device.

It is a further object of the present invention to provide a gunsight mounting device that is secured through the sideplate of a revolver.

It is a further object of the present invention to provide a gunsight mounting device that readily and repeatedly secured to a revolver, thereby insuring consistent and accurate mounting of a gunsight.

It is a further object of the present invention to provide a gunsight mounting device that is easily mounted by a shooter without need of a gunsmith or other technically skilled craftsman.

Other objects, features and advantages of the present invention will become apparent from reading the following specification in conjunction with the accompanying drawing.

BRIEF DESCRIPTION OF THE DRAWINGS

FIG. 2 is a right side elevation view of the gunsight mounting device of FIG. 1, shown attached to the revolver.

FIG. 3 is a rear plan view of the gunsight mounting device of FIG. 1, shown attached to a revolver and with a telescopic sight mounted thereon.

FIG. 4 is a left side elevation view of the disclosed embodiment.

DETAILED DESCRIPTION

Figure 1:
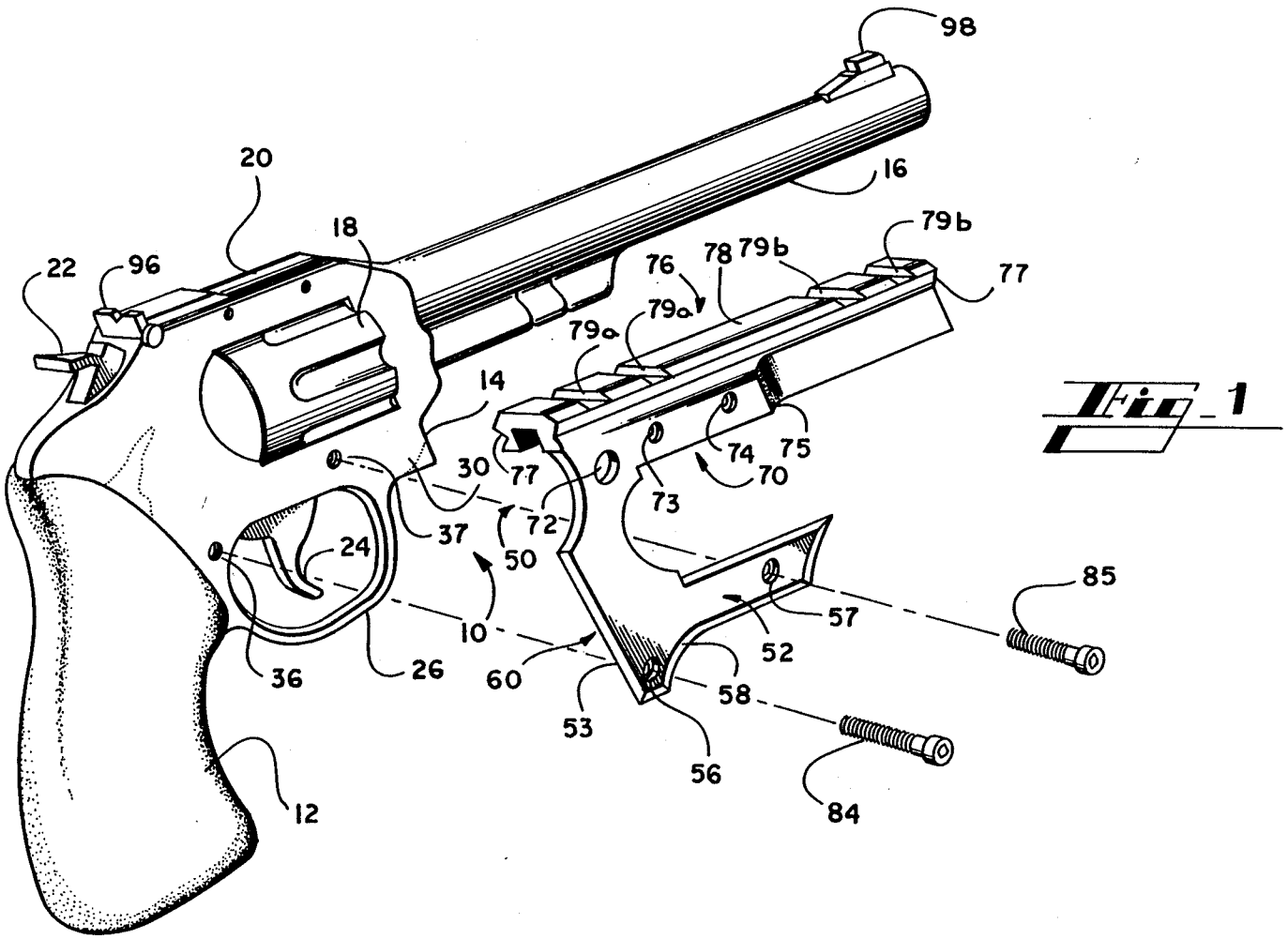
FIG. 1 is an exploded perspective view of a revolver and an embodiment of a gunsight mounting device according to the present invention.

Referring now in more detail to the drawings, in which like numerals indicate like parts throughout the several views, FIG. 1 shows a revolver generally indicated at 10. The revolver is conventional and will only be described to the extent necessary to understand the present invention.

The revolver 10 includes a hand grip 12, a frame 14 and the barrel 16. The frame is fitted with a rotating cylinder 18, within which ammunition in the form of cartridges are disposed for propulsion out the barrel 16. The top of the frame 14 defines a tap strap 20. A hammer 22 is provided at the back of the frame 14. A trigger 24 is operatively secured to the base of the frame 14 and rests within a trigger guard 26 to provide a fence thereabout. Those skilled in the art will appreciate that upon pulling the trigger 24, the hammer 22 is activated and, in combination with the action of gases within the firing chamber (not shown), causes a bullet to be discharged down the barrel 16.

A pair of sideplates including the right sideplate 30 are secured to the frame 14. A pair of screws (not shown) normally extend through aligned unthreaded openings 36 and 37 formed in the sideplate 30. The screws engage tapped holes (not shown) in the frame 14 and retain the sideplate 30 on the frame.

The gunsight mounting device of this invention is indicated generally at 50. The device 50 includes a lower horizontally extending portion 52 having a flat surface 53 configured to lie closely adjacent to the right-hand sideplate 30 of the revolver 10. The lower horizontally extending portion 52 is provided with a pair of openings 56 and 57 which are disposed coaxially with the aligned openings 36 and 37, respectively, when the device 50 is mounted on the revolver 10. The openings 56 and 57 are not threaded. The lower horizontally extending portion 52 includes an arcuate surface 58 that, as shown in the drawings, is formed correspondingly to the base of the frame 14 side plate 30 so as not to interfere with the pulling of the trigger 24.

The mounting device 50 further includes a substantially vertical portion 60. Portion 60 is formed integrally with the lower horizontal portion 50 and serves to interconnect the upper horizontal portion 70. The vertical portion 60 lies adjacent the sideplate 30 of the frame 14 in a manner similar to that of the lower portion 52. It will be appreciated that the vertical portion 60 is configured to circumvent the cylinder and permit normal operation of the revolver.

The upper horizontal portion 70 is characterized by three openings 72, 73 and 74. Openings 73 and 74 are preferably threaded for reasons explained hereinbelow. The upper horizontal section 70 toward its forward end is further characterized by a lower arcuate surface 75 that matches the curvature of the revolver barrel 16 and facilitates a snug attachment of the mounting device 50 to the revolver 10. It will be understood that the shape and extent of the lower arcuate surface 75 is determined by the shape of the barrel on the revolver for which a particular device 50 is designed.

A longitudinal rail 76 having dovetailed sides 77 is formed to extend along the top of the upper horizontal portion 70, as best seen in FIGS. 1 and 3. This dovetailed rail 75 accommodates the mating dovetailed slot mount conventionally provided on many auxiliary sighting devices such as the scope 80, FIG. 3. The top surface 78 of the rail 76 is flat and is interrupted by two pairs of transverse slots 79*a* and 79*b* which provide clearance for mounting bolts conventionally used by known scopes and sighting devices. The details of such mounting are known to those skilled in the art and further discussion is unnecessary. Any conventional securement may be used to attach the scope or sight to the gunsight mounting device 50 without departing from the spirit and scope of this invention.

The underside of the top horizontal portion 70 of the mounting device 50 is provided with two opposing rails 90 and 91, FIG. 3. The rails 90 and 91 oppose one another at an angle which presses the rails down onto the confronting radius of the top strap 20 on the revolver 10. The rails thus serve to center the mounting device 50 over the bore of the revolver 10 and provide maximum bearing surface area to receive the upward recoil of the revolver when fired. This concept, referred to as "angle mating", facilitates repeated accurate mounting of the mounting device 50 on the revolver 10.

The gunsight mounting device of the present invention further includes a pair of auxiliary screws 84 and 85, FIG. 1. The auxiliary screws 84 and 85 are sufficiently greater in length than the conventional sideplate screws they replace so as to accommodate the thickness dimension of the device 50, and are preferably formed with an enlarged head provided with engaging means such as a hex head receptacle. The forward end of each auxiliary screw 84 and 85 is threaded to facilitate mounting as described hereinbelow.

A gunsight and the above-described preferred embodiment of the present invention are secured to a revolver as follows. The conventional sideplate screws are removed from the openings 36 and 37, respectively. The mounting device 50 is then placed adjacent to the right side plate 30 of the revolver 10 with the rails 90 and 91 firmly pressed downwardly on the topstrap 20 of the revolver. The auxiliary screws 84 and 85 are inserted in the openings 56 and 57 of the lower portion 52 and through the openings 36 and 37 in the right sideplate 30, and are then screwed into the existing tapped openings in the revolver frame, by means of an appropriate tool such as an Allen wrench or the like. When the auxiliary screws 84 and 85 are in place within the frame 14, the auxiliary screws replace the original sideplate screws and secure the lower portion 52 to the frame 14 through the sideplate 30. Once secured by tightening the auxiliary screws 84 and 85 within the frame 14, the mounting device 50 is secured to the revolver 10 ready to receive the sight 80 as shown in FIG. 3. Once the sight 80 is mounted on the mounting device 50, the sight is sighted-in with a target in the conventional manner.

A ledge 92, FIGS. 3 and 4, extends downwardly from the lower edge of the rail 90 on the left side 94 of the top horizontal portion opposite from the vertical portion 60. When the mounting device 50 is attached to the revolver, the ledge 92 extends down past the left side of the top strap 20 and rests against the left side of the frame 14 as seen in FIG. 3. This ledge protects the mount 50 from being broken off the gun by a blow from the left side, an impact which could shear the relatively small auxiliary screws 84 and 85 attaching the mount to the revolver frame. The back end of the left side 94 is relieved at 95 for access to the left side of the conventional rear iron sight 96 on the revolver.

Those skilled in the art will appreciate that the gunsight mounting device of the present invention is of simple construction and can be quickly and easily mounted on a revolver without the need of any auxiliary drilling or tapping of the revolver by a gunsmith or by the factory. Further, the "angle mating" concept of the present invention provides for the mount to be removed and consistently and accurately reattached to the revolver, in turn providing for the scope 80 or other sighting device (once initially mounted on the mounting device 50 and sighted-in) to be consistently and accurately reattached to the revolver. Thus, the present invention provides an additional benefit in that the shooter saves ammunition by not needing to sight-in each time the scope 80 and mount 50 are removed and reattached to the revolver.

With the mount 50 attached to the revolver 10, the open longitudinal channel 97, FIG. 3, between the rails 90 and 91 accommodates the existing iron rear sight 96 on the topstrap 20. Furthermore, the open channel 97 leaves the existing rear sight 96 and front sight 98 visible to the shooter. The attached mounting device 50 thus does not interfere with use of the existing sights on the revolver, at the shooter's discretion. The relatively large opening 72 located toward the rear of the upper horizontal portion 70 accommodates the windage adjustment screw of an adjustable rear sight 96 on the revolver.

The two threaded openings 73 and 74 in the upper horizontal portion are provided to receive the two conventional sideplate screws, when those screws are removed from the revolver frame for attaching the mounting device 50. The conventional sideplate screws thus are kept with the mounting device 50 and are immediately available whenever the mounting device is removed for any reason.

It should be understood that the foregoing relates only to a preferred embodiment of the present invention and that numerous modifications or alterations may be made therein without departing from the spirit and scope of the invention as set forth in the appended claims.

What is claimed is:

1. A gunsight mounting device for a revolver having a barrel and a side plate, the mounting device comprising:

means for receiving a gunsight, said receiving means including a first portion configured to lie closely adjacent to the side plate on a single side of the revolver, and a second portion formed integrally with said first portion and including a lower surface configured to overlie and contact a top surface of the revolver in a predetermind fixed location thereon;

means for attaching said receiving means to said single side of the revolver; and a ledge formed integrally with said second portion of the receiving means on the side thereof opposite the first portion, said ledge resting snugly against the other side of the revolver without attachment thereto, so as to protect the mounting device from being broken off the gun by an impact from the other side, whereby a gunsight may be mounted upon said revolver in a predetermined location relative to the barrel for use by a shooter.

2. The gunsight mounting device of claim 1, said attaching means comprising at least one threaded member for engaging an existing threaded hole in said side and engaging said first portion of said receiving means.

3. The gunsight mounting device of claim 1, said attaching means comprising two threaded members for engaging two existing threaded holes in said side plate and engaging said first portion of said receiving means.

4. A gunsight mounting device for a revolver having a barrel and first and second sides, the mounting device comprising:

means for receiving a gunsight, said receiving means including a substantially nonresilient first portion configured to lie adjacent to the first side of the revolver, and a second portion formed integrally with said first portion and configured to overlie a top surface of the revolver;

said second portion of said receiving means defining an upper surface and a lower surface, said lower surface including two opposing, downwardly facing surfaces that contact the barrel of the revolver and center the device about the radius thereof; and means for securing the first portion of said receiving means to the first side of the revolver, whereby a gunsight may be mounted upon the revolver in certain predetermined position for use by a shooter.

5. The gunsight mounting device of claim 4, one of said downwardly facing surfaces being on the same side of the mounting device as the attaching means, and the other of said downwardly facing surfaces having means extending downwardly to rest against the other side of the revolver, thereby helping retain the mounting device on the revolver.

6. The gunsight mounting device of claim 4, wherein said downwardly facing surfaces comprise downwardly projecting rails that contact the barrel of the revolver and center the device about the radius thereof.

7. A gunsight mounting device for a revolver having a barrel and at least one side plate, the mounting device comprising:

means for receiving a gunsight, said receiving means including a substantially nonresilient rigid first portion configured to lie closely adjacent to the side plate on a single side of the revolver, said first portion further including at least one threaded opening positioned for communication with an opening disposed within said one side plate, a second portion configured to overlie a top surface of said revolver, said second portion including means for receiving a sighting device;

a third portion interconnecting and integrally formed with said first portion and said second portion to thereby provide an integral means for receiving said gunsight;

the second portion further including a lower surface facing downwardly to contact the top surface of the revolver in a predetermined fixed location thereon; and at least one threaded member configured for receipt by said first portion of said receiving means and engaging on existing threaded hole in one said side, whereby upon threaded connection of said threaded member to said side, said receiving means is secured to the revolver and lies adjacent said single side plate of said revolver, affixing said lower surface to the top surface of the revolver in said predetermined location and in turn securing the sighting device in a predetermined location relative to the barrel, to be utilized by a shooter.

8. The gunsight mounting device of claim 7, said lower surface being configured for frictional engagement to the top of said revolver whereby said gunsight mounting device is centered about the top of the revolver.

9. A gunsight mounting device for a revolver having a barrel and at least one side plate, the mounting device comprising:

means for receiving a gunsight, said receiving means including a first portion configured to lie adjacent to one side of the revolver, said first portion further including at least one threaded opening positioned for communication with an opening disposed within said one side, a second portion configured to overlie a top surface of said revolver, said second portion including means for receiving a sighting device, and a third portion interconnecting and integrally formed with said first portion and said second portion to thereby provide an integral means for receiving said gunsight;

said second portion of said receiving means defining an upper and a lower surface, said lower surface being configured for frictional engagement to the top of the revolver whereby said gunsight mounting device is centered about the top of the revolver;

at least one threaded member configured for receipt by said first portion of said receiving means and engaging an existing threaded hole in one said side, whereby one threaded connection of said threaded member to said side, said receiving means is secured to the revolver and lies adjacent said one side plate of said revolver, in turn securing said gunsight in position to be utilized by a shooter; and two threaded openings dimensioned for receipt for existing side plate screws removed from the revolver, for retention thereof during utilization of said gunsight mounting device.

* * * * *